United States Patent [19]

Dimond, deceased et al.

[11] 3,961,463

[45] June 8, 1976

[54] SELF-RELEASING CAPPER CHUCK

[75] Inventors: George H. Dimond, deceased, late of East Aurora, N.Y.; by Frederick C. Jensen, executor, Elma, N.Y.

[73] Assignee: A-T-O Inc., Willoughby, Ohio

[22] Filed: July 14, 1975

[21] Appl. No.: 595,352

[52] U.S. Cl. ..... 53/306; 53/319; 53/330

[51] Int. Cl.[2] ..... B65B 7/28

[58] Field of Search ..... 53/306, 319, 321, 330, 53/317, 329, 201, 344, 351, 353

[56] References Cited

UNITED STATES PATENTS

| | | | |
|---|---|---|---|
| 2,609,735 | 9/1952 | Farrell et al. | 53/319 X |
| 2,817,202 | 12/1957 | Lyon | 53/330 |
| 2,975,575 | 3/1961 | Nalbach et al. | 53/330 |
| 3,242,632 | 3/1966 | Dimond | 53/317 X |
| 3,668,824 | 6/1972 | Solomonov et al. | 53/330 |

*Primary Examiner*—Travis S. McGehee
*Assistant Examiner*—Horace M. Culver
*Attorney, Agent, or Firm*—Christel & Bean

[57] ABSTRACT

Interchangeable internally gripping chucks for use in a machine applying non-rotative closures to containers, the machine having a multi-station rotary turret arrangement for receiving the containers from a feed conveyor. Each chuck is attached to a spindle in the rotary turret and includes spring loaded jaws for gripping a closure and seating it into or onto the upper portion of a container. The jaws are respectively biased radially outward by the spring loading means, and as the chuck descends and engages the inner edge of the closure, the jaws slip to grip the closure for pick-up and transport to the capping zone. The chuck further includes a releasing mechanism which is activated upon a "bottoming-out" of the chuck upon the top of the container. The releasing mechanism forces the jaws radially inward, disengaging them from the closure so that the chuck can be upwardly retracted from the closed container without any tendency to withdraw the closure, even when the closure has a loose fit.

8 Claims, 5 Drawing Figures

SELF-RELEASING CAPPER CHUCK

BACKGROUND OF THE INVENTION

This invention relates generally to an automatic chuck structure as would be used in, but not limited to, a multi-station rotary turret type of automatic capping machine. More specifically, the present invention relates to an internally gripping chuck structure which grips a closure internally and inserts it into the upper portion of a container.

In certain types of machines for applying closures to containers, there is employed a rotary turret having a series of capping stations around its periphery which vertically reciprocate attached chuck means to pick up each closure and to seat the latter into or onto the upper portion of a container. For handling non-rotative closures with such machines it has been expedient to employ some adaptation of the externally gripping chuck shown in FIGS. 16 through 22 of U.S. Pat. No. 3,616,513 to Dimond, issued to the same assignee as the present invention.

Although various versions of the U.S. Pat. No. 3,616,513 chuck have been devised, it is not entirely suitable for the particular bottle and internal plug used as example herein. This bottle is a flexible one which, without special support, would collapse under the thrust of plug insertion.

The bottle has an integrally moulded collar around its neck portion to receive the required support from suitable means during plug insertion. The level of this collar is such that the supporting plane is only about 3/16 inch below the bottom of the inserted plug. The U.S. Pat. No. 3,616,513 chuck typically requires at least 3/16 inch spindle over-travel to stabilize the jaws in released condition before upward withdrawl. In practice, however, at least ¼ inch overtravel must be provided to allow for slight variations in container height so that a possibility of overtravel interference with the supporting plane exists.

Another difficulty associated with prior chucks with respect to the chucking operation considered herein resides in the fact that the externally gripping chuck necessarily would contact the outer surface of the chucked plug and at least a portion of such outer surface comes into sealing contact with the mouth of the bottle. In various situations this could be objectionable on sanitary grounds.

SUMMARY OF THE INVENTION

In consideration of the above, a prime object of the present invention is to devise an improved self-releasing chuck which will shift from gripping state to stable release state with a substantially reduced overtravel requirement.

A further object of the present invention is to provide a closure applying chuck of an internally gripping type comprising comparatively simple mechanical components which are economical to manufacture and thoroughly reliable in operation.

The present invention provides an internally gripping chuck for a capping machine in which each chuck applies positive internal gripping force to the wall of a closure. Each chuck includes jaws at its lower end and spring loading means for maintaining the jaws in engagement with the wall of the closure during the downward movement of the chuck. As the chuck descends farther, with the jaws bottoming out on the top of a container, an outer body portion of the chuck slides downward with respect to the jaws and urges the latter radially inward to disengage them from the wall of the closure. Thereupon an interlock means is activated to maintain the jaws in their released condition. In this condition the jaws are upwardly withdrawn from the closure as the chuck is reciprocally raised by the machine spindle to which it is attached.

The foregoing and other objects, advantages and characterizing features of the present invention will become clearly apparent from the ensuing detailed description of an illustrative embodiment thereof, taken together with the accompanying drawings wherein like reference characters denote like parts throughout the various views.

DETAILED DESCRIPTION OF A PREFERRED EMBODIMENT

Figure 1:
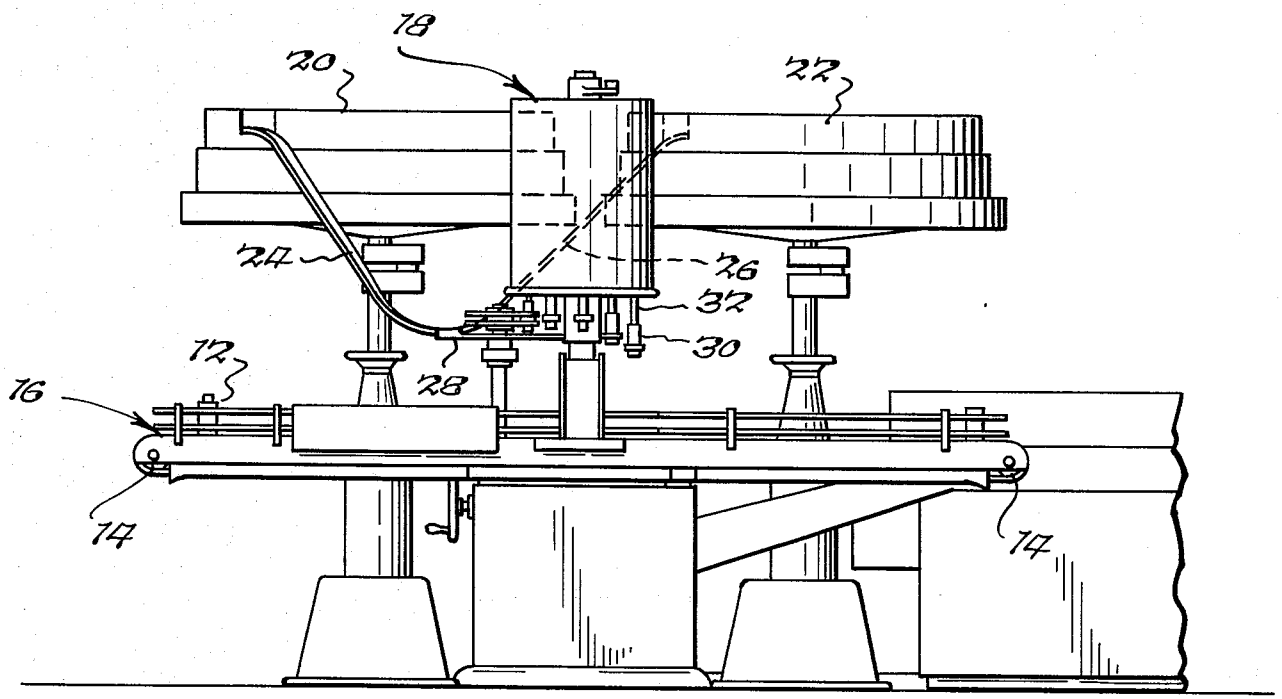
FIG. 1 is a simplified elevational view of a capping machine for applying closures to containers in accordance with an illustrative embodiment of the invention.
Figure 2:
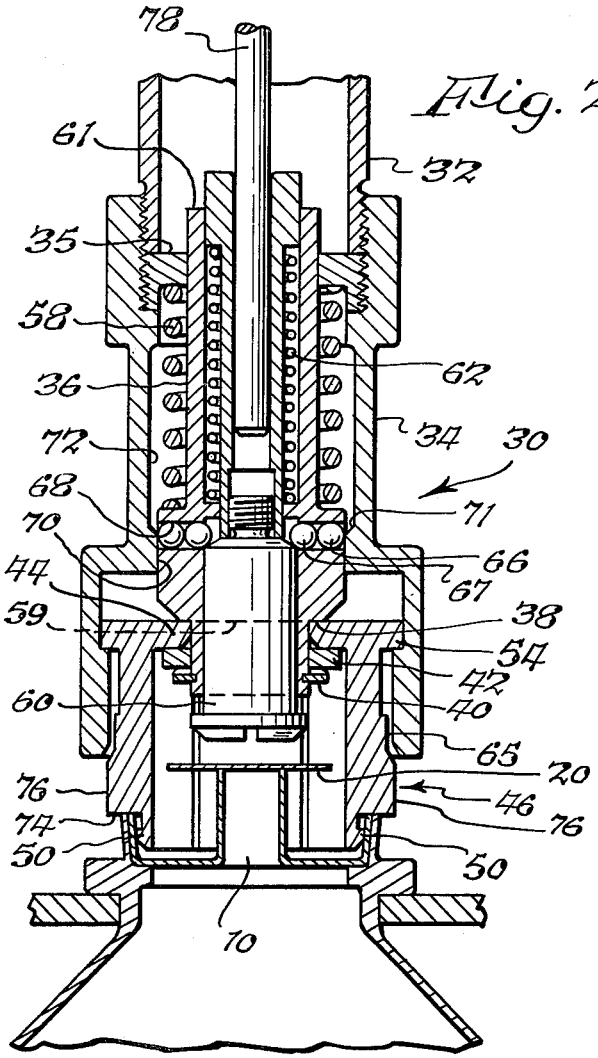
FIG. 2 is an enlarged vertical sectional view of the internally gripping chuck constituting the present invention, together with a representative closure engaged by the jaws of the chuck during the pick-up, chucking phase of operation.
Figure 3:
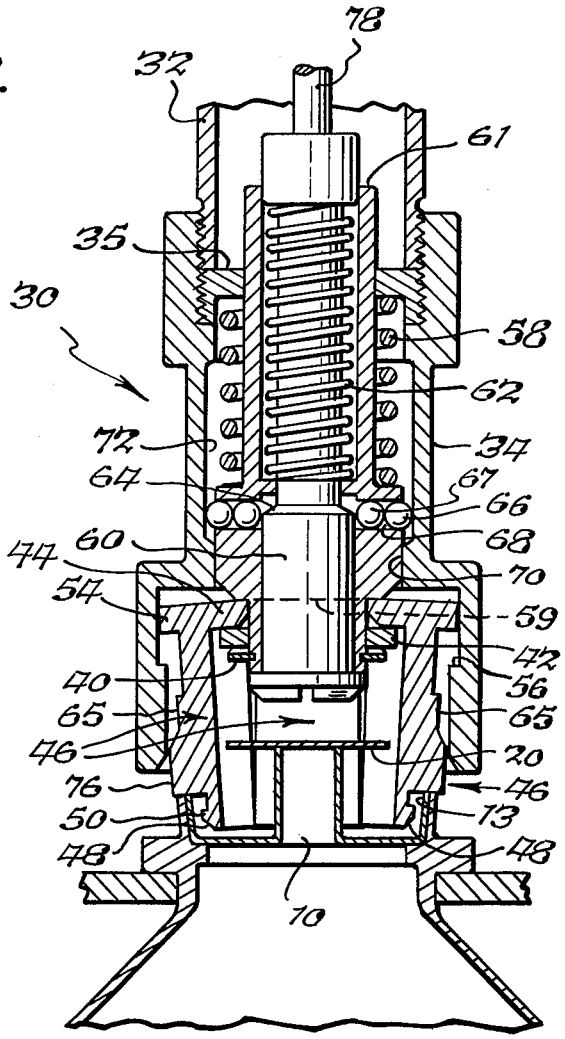
FIG. 3 is a view similar to FIG. 2 but showing the jaws disengaged from the closure subsequent to seating of the latter into the neck of a container.

Referring to FIG. 1 of the drawings, there is shown a machine for applying closures, such as the plugs 10 (FIG. 2), to a series of containers 12 as generally shown in FIGS. 2 and 3. The machine is equipped with chucks which engage the internal wall surface of each closure 10 and seat the closure into engagement with its respective container.

As a prologue to the detailed description of the internal gripping chuck illustrated in the drawings, there will be first given a discussion of the general mode of operation of the capping machine shown in FIG. 1.

The containers 12 to which the closures 10 are to be applied are either automatically or manually deposited one by one on an elongated belt 14 which forms a part of a container feeding mechanism 16. The belt 14 advances the incoming containers 12 from left to right as viewed in FIG. 1, toward a continuously rotating turret 18. As the incoming containers are moved forward, they are uniformly spaced on the belt 14 by means well known in the art and fully described in U.S. Pat. No. 3,242,632 to Dimond also issued to the same assignee as the present invention.

During the time the aforesaid container feeding mechanism 16 is operative to position the containers 12 beneath the rotating turret 18, successive closures 10 are supplied to the turret 18 from a supply chute 26, and are each received by a transfer mechanism 28 associated with each passing turret station.

It is to note that the example closures cannot be sorted or hoppered at all, because the foil tear tabs 20, FIGS. 2 and 3, would be mangled thereby. Instead, they are conveyed directly to the capper without loss of orientation.

The transfer mechanism 28 successively feeds closure to the chucks 30 which constitute the present invention.

The turret 18 carries a number of vertically reciprocable chucks 30 which are best shown in FIGS. 2 and 3. Chuck spindles 32 are spaced around the periphery of the turret and their vertical reciprocation relative to the turret 18 is controlled by a camming mechanism as described in reference U.S. Pat. No. 3,242,632 so that the chucks rise and fall during the horizontal translation of the containers 12. After the closures have been applied to the containers by the chucks, the newly closed containers are moved to the right by the belt 14 to a suitable discharge point.

The subject matter of the present invention is shown in detail in FIGS. 2–5. As seen in FIGS. 2 and 3, each chuck assembly 30 is threaded onto a turret spindle 32 shown in fragmentary section. The spindle 32 is threaded into the upper end portion of an outer body assembly comprising outer body 34 and annulus 35 threaded thereinto just below the spindle. An inner body member 36 is coaxially and slidably disposed within the outer body assembly, and is urged constantly downward relative thereto by the jaw spring 58. The lower end portion of the inner body 36 includes a shoulder 38 and carries a bowed retaining ring 40 a short distance therebelow with a washer 42 intermediate thereto.

Figure 5:
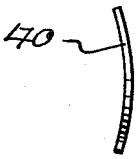
FIG. 5 is an elevational view showing a detached retaining ring.

The bowed retaining ring 40 is detailed separately in FIG. 5 because it cannot be shown clearly in the sectional assembly views. When partially flattened as in the assembly, it acts as a short-throw axial thrust spring.

Figure 4:
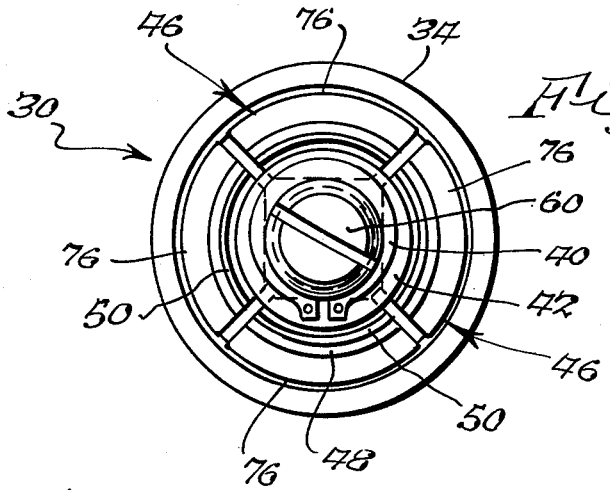
FIG. 4 is a bottom view of the chuck.

The combination of the shoulder 38 and the retaining ring 40 with the supported washer 42 forms a resilient suspension for the internal lugs 44 on the four jaw members 46, 46, 46, 46 in FIG. 4.

The inner body 36 is round in cross-section except for a short portion between shoulder 38 and washer 42. Here it is square, as indicated by dotted lines in FIG. 4, to provide flat-sided rocker pockets for the jaw lugs 44, and to maintain the jaws at uniform 90° spacing about inner member 36. The transition 59 is indicated by dotted line in FIGS. 2 and 3. The jaws can rock in the aforesaid rocker pockets while being retained snugly against the shoulder 38 by the resilient retaining ring and washer 42. Arcuate external lugs 54 are also provided on the jaws to engage an annular fulcrum ledge 56 provided within the lower cavity of the outer body 34. Thus, as shown in FIG. 2, the thrust of spring 58, via inner body 36, urges the jaws to swing radially outward upon engagement of the lugs 54 with the fulcrum ledge 56. The jaw members, having gripping lips 50, can therefore be made to engage the inner wall surface 13 of a closure 10 so as to grip the latter outwardly for pick-up and transport to the insertion zone. Such operation of the chuck will be more fully described hereinbelow.

The chuck further includes a stripper 60 threaded into stripper stem 61, and this assembly is coaxially and slidably mounted within the inner body 36. The stem 61 is bored for sliding engagement with rod 78. A stripper retraction spring 62 is disposed between the head of the stripper stem and a shoulder on the inner body 36 so as to urge the stripper constantly upward with respect to the inner body. The upper portion of the stripper 60 has a sloped shoulder 64 which engages a plurality of paired balls 66, 67 disposed within radial passages 68 in the inner body. As shown in FIGS. 2 and 3, the balls communicate with the inner wall of the outer body. The combination of the spring biased sloping shoulder 64 on the stripper, the balls 66, 67 and the slopingly stepped bore 70, 71, 72 of the outer 96 collectively form an interlock means, the operation of which will be more fully described hereinafter.

During the operation of the capping machine, the successive closures 10 are each presented coaxially below one of the chucks 30 on one of the spindles 32. The spindle then lowers the chuck for pick-up, with the jaw spring 58 urging the inner body 36 downwardly with respect to the outer body so that the jaw lugs 54 are engaged with the fulcrum ledge 56, causing the lower ends of the jaws to expand radially outward. In this disposition, before engagement with the closure, the jaws of course expand until their lands 65 press outward against the outer body 34. This can be considered the "ground state" of the chuck as the cycle begins.

As the chuck descends toward the FIG. 2 level, where the closure 10 awaits pick-up, the chamfered jaw tips 48 engage the inner edge of the closure rim and lead the gripping lips 50 into the closure cavity, thereby transferring the outward jaw pressure from the outer body wall to the closure wall 13. Then, when the jaw shoulders 74 have approached the closure rim as shown, the jaw shoulders 74 thrust the closure into the bottle neck and "bottom out" thereon. As descent of the jaws and inner body 36 is thus arrested, spring 58 yields, while the spindle and outer body 34 overtravel to the limit of their fixed stroke, with the lower end of the outer body overriding the releasing shoulders 76 on the jaws. Such override forces the jaws radially inward, thereby disengaging gripping lips 50 from the closure wall 13 as shown.

The interlock ball mechanism now comes into play. Depending upon the relative axial positions of inner and outer bodies, either the inner balls 67 protrude inwardly from the body wall, with the outer balls 66 flush with same per FIG. 2, or in reverse per FIG. 3, with the outer balls protruding and inner balls flush.

In the former case the chuck is stable in its active gripping state, per FIG. 2, and remains so until the jaws and inner body have been arrested by the seating of the closure, and the outer body has begun to overtravel and to override the jaw lands 76. During this initial bit of overtravel, the shoulder 71 clears the outer balls 66. Instantly thereupon the spring 62 raises the stripper 60, displacing the balls to their FIG. 3 position and locking them therein.

Any further slight overtravel of the spindle and outer body, to the limit of their fixed stroke, allows for normal variations in container height.

The chuck is now stable in its passive release state, and will remain so while the reciprocal rise of the spindle and outer body lifts shoulder 71 into re-engagement with the now protruding outer balls 66. It is to be appreciated that rising shoulder 71 encounters the protruding outer balls 66 before the jaw lugs 54 regain their fulcrum bearing on shoulder 56, and before the jaw lands 76 escape the constriction of the body 34. Since the protruding balls are locked. the shoulder 71 cannot pass them, and perforce carries them along, together with the inner body, the constricted jaws, and all other components, leaving the closure seated in the container regardless of possible loose fit.

After a sufficient further rise of spindle and outer body, the rod 78 depresses the stripper 60 with respect to the inner body 36, until it clears the inner balls 67. Instantly thereupon the spring 58 lowers the inner body, returning the balls to their FIG. 2 position and locking them therein. The chuck has now been re-set to the previously described ground state, and is ready for the next cycle.

The slope of shoulders 64 and 71 is such that the axial motion between inner and outer bodies required to effect the lateral ball shift is nominally equal to the ball radius. Because it is necessary to minimize this axial motion, small balls are used in pairs as shown, rather than larger single balls which would be required for the same lateral span.

It is to be further noted that the example closure has a selective foil tear tab 20 atop the spout 17. The radial clearance between the tab extremities and the closure wall 14 is restrictive. Therefore the inward excursion of the jaws must be minimized to prevent unacceptable deformation of the tab as the chuck is raised after closure insertion.

In considering the previously described situation wherein the rising shoulder 71 encounters the balls, it can be realized that the 46 jaws, having lost their fulcrum bearing on ledge 56, and now losing contact with the bottle neck, would be free to droop farther inward then shown unless prevented therefrom by some means. The washer 42 and the bowed retaining ring 40 constitute such means. Washer 42, being urged constantly upward by bowed ring 40, and having a periphery larger than that of shoulder 38, exerts an upward and outward moment on the jaws, so that the jaws continue to hug the wall of body 34, thus allowing maximum clearance for tab 20 during upward passage of the jaws.

Upon subsequent descent of the chuck, for the next cycle the component parts thereof will revert to the relationship shown in FIG. 2 as the chuck proceeds to engage the next closure.

From the foregoing, it is apparent that the objects of the present invention have been fully accomplished. As a result of this invention, an improved self-releasing chuck is provided for picking up non-rotative closures and applying them to mating containers.

It is claimed:

1. A vertically reciprocable internally gripping chuck for a machine applying closure elements to a series of containers presented therebeneath, the machine having means adapted to operate on successive containers provided along a feed path and a plurality of said vertically reciprocable chucks mounted thereon and successively positioned above and in substantial vertical alignment with the containers, supply means containing closure elements, and means for successively feeding closure elements from said supply means to said chucks, each of said chucks comprising:

a spindle means adapted for connection to said machine;

an outer body having upper and lower end portions, said outer body member being attached at said upper end portion thereof to said spindle means;

an inner body member having upper and lower end portions and being co-axially disposed within said outer body member and slidable therein;

jaw means, said jaw means being pivotedly suspended from said lower end portion of said inner body member and having flange means adapted for internally engaging closure elements;

a jaw spring means, said jaw spring means being disposed between said inner and outer body members for urging said inner body member in a downward direction with respect to said outer body member so that said jaw means are urged to pivot radially outward to internally engage closure elements; and interlock means operatively disposed between said inner and outer body members, said interlock means retarding the downward movement of said inner body member as induced by said jaw spring means after disposition of a closure element onto a container so that said jaw means may release from the closure element by pivoting radially inward.

2. A vertically reciprocable chuck as set forth in claim 1 further including a pivot shoulder on said lower end portion of said outer body member whereby said jaw means pivots radially outward upon engaging said pivot shoulder.

3. A vertically reciprocable chuck as set forth in claim 2 wherein said lower end portion of said inner member includes a suspension notch and said jaw means includes a mounting flange, and wherein said mounting flange is disposed within said suspension notch.

4. A vertically reciprocable chuck as set forth in claim 3 wherein said suspension notch comprises a shoulder on said inner body member and a bowed retaining ring disposed on said inner body member with said mounting flange of said jaw means being disposed therebetween and resiliently urged toward said shoulder on said inner body member.

5. A vertically reciprocable chuck as set forth in claim 2 wherein said jaw means includes a releasing shoulder on the outer surface thereof and said outer body member includes a releasing cam portion on the inner surface thereof and upon completion of a closure element disposition said outer body member travels over said releasing shoulder forcing said jaw means to pivot radially inward and release from the closure element.

6. A vertically reciprocable chuck as set forth in claim 5 wherein said interlock means comprises biasing means and friction means being disposed on one of said body members and said biasing means urging said friction means against the other of said body members and upon travel of said outer body member over said releasing shoulder said biasing means increasingly urges said friction means against said other body member to retard the downward urging by said jaw spring means of said inner body member with respect to said outer body member.

7. A vertically reciprocable chuck as set forth in claim 6 wherein said friction means comprises roller means disposed in a slot in said inner body member and said biasing means urges said roller means outwardly through said slot against the inner surface of said outer body member.

8. A vertically reciprocable chuck as set forth in claim 7 wherein said biasing means comprises a spring loaded element having a sloped face engaging said roller means and wherein the inner surface of said outer body member includes a recess so that upon travel of said outer body member over said releasing shoulder said roller means engages said recess and is so urged against said outer body member to retard the downward urging of said inner body by said jaw spring means so that said jaw means are disposed to release from the closure element.

* * * * *

UNITED STATES PATENT AND TRADEMARK OFFICE

CERTIFICATE OF CORRECTION

PATENT NO. : 3,961,463

DATED : June 8, 1976

INVENTOR(S) : George H. Dimond, deceased, late of East Aurora, N.Y.; by Frederick C. Jensen, executor, Elma, N.Y.

It is certified that error appears in the above-identified patent and that said Letters Patent are hereby corrected as shown below:

Claim 3, line 2 after "inner" add --body--.

Signed and Sealed this

Seventh Day of September 1976

[SEAL]

*Attest:*

RUTH C. MASON
*Attesting Officer*

C. MARSHALL DANN
*Commissioner of Patents and Trademarks*